US005180427A

United States Patent [19]

Prasad et al.

[11] Patent Number: 5,180,427

[45] Date of Patent: Jan. 19, 1993

[54] FILLERS FOR INVESTMENT AND REFRACTORY DIE MATERIALS

[75] Inventors: Arun Prasad, Cheshire, Conn.; Carlino Panzera, Belle Mead, N.J.

[73] Assignee: Jeneric/Pentron, Inc., Wallingford, Conn.

[21] Appl. No.: 827,150

[22] Filed: Jan. 28, 1992

[51] Int. Cl.[5] ..... C09K 3/00; B28B 7/28

[52] U.S. Cl. ..... 106/35; 106/38.3; 106/38.35; 106/38.9

[58] Field of Search ..... 106/35, 38.2-38.9, 106/637, 691

[56] References Cited

U.S. PATENT DOCUMENTS

| | | | |
|---|---|---|---|
| 3,647,488 | 3/1972 | Brigham et al. | 106/35 |
| 4,478,641 | 10/1984 | Adair et al. | 501/72 |
| 4,536,216 | 8/1985 | Kaluzhsky et al. | 106/38.3 |
| 4,604,142 | 8/1986 | Kamohara et al. | 106/38.51 |
| 4,709,741 | 12/1987 | Nakamura | 164/35 |
| 4,798,536 | 1/1989 | Katz | 433/212.1 |
| 4,830,083 | 5/1989 | Nakamuar | 164/35 |
| 4,947,926 | 8/1990 | Ogino et al. | 164/519 |
| 5,022,921 | 6/1991 | Aitken | 106/38.9 |

*Primary Examiner*—William R. Dixon, Jr.
*Assistant Examiner*—Margaret Einsmann
*Attorney, Agent, or Firm*—Watson, Cole, Grindle & Watson

[57] ABSTRACT

Phosphate-bonded investments and refractory die materials are provided upon which dental porcelains and/or alloy powders can be sintered. Inorganic fillers are mixed with appropriate binders to produce mold materials which exhibit very high thermal expansion properties without exhibiting any large or sudden change in their thermal expansion verse temperature profile. Investments and refractory die materials having thermal expansions of greater than 0.80% in the range of 25°-500° C. are provided by incorporating leucite ($KAlSi_2O_6$) or calcium difluoride ($CaF_2$), or both, as fillers for investments and refractory die materials.

18 Claims, 4 Drawing Sheets

FILLERS FOR INVESTMENT AND REFRACTORY DIE MATERIALS

FIELD OF INVENTION

The present invention relates to inorganic fillers for phosphate-bonded investments and refractory die materials upon which dental porcelains and/or alloy powders can be sintered.

BACKGROUND OF THE INVENTION

Current phosphate-bonded investments and refractory die materials utilize fillers selected from quartz, tridymite and cristobalite to provide a degree of thermal expansion which is acceptable for sintering conventional porcelains having percent thermal expansion values lower than 0.65% in the temperature range of 20°-500° C. These fillers are combined with binders containing magnesium oxide, mono- or di-ammonium phosphate and colloidal-silica suspensions which provide physical expansion and strength. Trace amounts of surfactants are also added to control dispersion and surface properties of the fillers and binders. Problems exist, however, when such filler and binder combinations are used in developing phosphate-bonded investments and refractory die materials for higher expansion dental porcelains.

The primary difference between investments and refractory die materials lies in the selection of the particle size distribution of the fillers. Investments usually have a coarser particle size distribution. Investments are primarily used as the mold materials for the casting of dental alloys using lost wax processes. Refractory die materials are conventionally utilized as substrates for sintering dental porcelains and alloy powders and thus are subjected to high temperature firing cycles. Both investments and refractory die materials are formulated to provide proper setting, thermal and net positive physical expansion.

Although the silica-based fillers are inexpensive, they suffer from phase transformations at their transformation temperatures. These phase transformations cause sudden and large changes in the thermal expansion of the fillers. FIG. 1 is a graph showing thermal expansion verse temperature profiles for some of the industrial filler materials. It is apparent that the three forms of silica—quartz, tridymite and cristobalite—undergo phase transformation from an alpha form to a beta form. The profiles indicate that each transformation is accompanied by a large change in thermal expansion at the transformation temperature. For example, alpha-quartz converts to beta-quartz at about 573° C. with a thermal expansion change of about 0.5%. Similarly, alpha-cristobalite transforms to a beta-form at a temperature between about 200° C. and about 270° C., and produces a thermal expansion change of about 1.0%. The beta forms are stable only above the transformation temperatures. Upon cooling each composition, an inversion back to the lower alpha-form occurs.

Usually, a proper proportioning of these allotropes is controlled to arrive at the desired thermal expansion verse temperature profile to match the intended application. The addition of binders has only a minor influence on the thermal expansion behavior.

Low temperature phase transformation associated with the use of alpha-cristobalite, in most instances, does not pose problems in investments used for obtaining dense casting of dental alloys using the lost-wax technique. However, phosphate-bonded refractory die materials containing these different allotropes of silica as fillers exhibit the sudden and large changes (referred to herein as spikes) at the phase transformation temperatures. When used as a die (substrate) for sintering dental porcelain and alloy powders, compositions containing such fillers are prone to the formation of micro and macro-defects in the overlaid green (unsintered) products. These defects, if not repaired during sintering, get carried into the final sintered products.

The above phenomena is especially prevalent where the overlaid layers differ considerably in their thermal expansion values when compared to the thermal expansion of the die-material. The use of alpha-quartz alone as a filler appears to be acceptable for dental porcelains having low thermal expansions, e.g. $<0.65\%$ in the 25°-500° C. range. However, many of today's dental porcelains exhibit thermal expansions of greater than 0.80%. In fact, many of the dental porcelains currently being used have thermal expansions of between 0.84 and 0.87%. One such class of porcelains is Optec ® porcelains, available from Jeneric/Pentron, Wallingford, Conn. Due to the strength of some of these porcelains, crowns and bridges have been produced without the need for metal substrates.

In order to accommodate the sintering of higher expanding dental porcelain and alloy powders, efforts have been made to replace part of the alpha-quartz filler with an alpha-cristobalite filler. These attempts have been unsuccessful though since the presence of cristobalite produces a spike in the thermal-expansion verse temperature profile in the range of 200° to 270° C. The spike produces interfacial tensile stresses between the substrate and the green overlay which is inevitably detrimental to the integrity of the final restoration. Theoretically, it is preferred to have a compressive mode of stress at the interface of the die material and the overlaid material to eliminate defects in the final restoration. This is accomplished by having a refractory die material which has higher thermal expansion values than those of the materials being sintered thereon.

SUMMARY OF THE INVENTION

The present invention provides phosphate-bonded investments and refractory die materials upon which dental porcelains and/or alloy powders can be sintered. According to the present invention, inorganic fillers are mixed with appropriate binders to produce die materials which exhibit very high thermal expansion properties without exhibiting any large or sudden changes in their thermal expansion verse temperature profile. The compositions of the present invention may also preferably be formulated so that their profiles are very similar to the profiles of the overlaid materials to be used in conjunction therewith.

The present invention eliminates the problem of abrupt discontinuous changes in thermal expansion while offering higher thermal expansion values. Investments and refractory die materials having thermal expansions of greater than 0.80% in the range of 25° to 500° C. are provided according to the present invention by incorporating leucite ($KAlSi_2O_6$) or calcium difluoride ($CaF_2$), or both, as fillers for investments and refractory die materials. In accordance with the present invention, it has been found that leucite and $CaF_2$ possess high thermal expansion characteristics.

The invention may be more fully understood with reference to the accompanying drawings and the following description of the embodiments shown in those drawings. The invention is not limited to the exemplary embodiments but should be recognized as contemplating all modifications within the skill of an ordinary artisan.

DETAILED DESCRIPTION OF THE INVENTION

Figure 1:
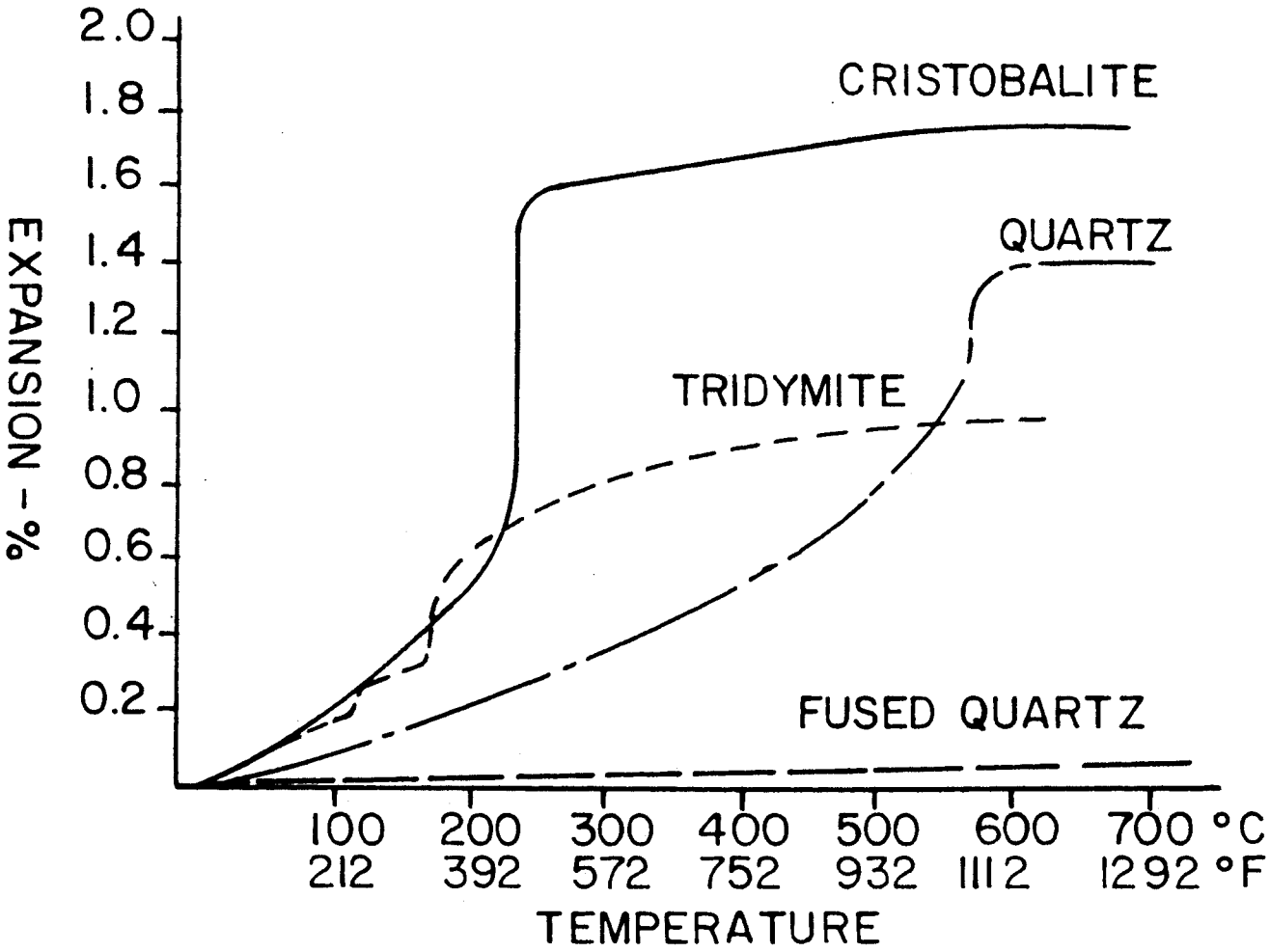
FIG. 1 is a graph showing the thermal expansion of four forms of silica currently used as fillers for investments and refractory die materials.

According to the present invention, leucite or calcium difluoride, or both, are used as fillers for investments and refractory die materials, especially those used for casting alloys, and sintering dental porcelains and alloy powders, respectively. The investments and refractory die materials of the present invention exhibit thermal expansions which equal or exceed the thermal expansion of today's high expanding dental porcelains. In a particular embodiment, investment and refractory die materials according to the present invention exhibit a thermal expansion of greater than 0.80% at 500° C. without exhibiting a spike in the thermal expansion verse temperature profile.

The preparation of leucite and $CaF_2$ powders are well known in the art. Leucite may be produced using pure oxides ($SiO_2$, $K_2O$, $Al_2O_3$) as starting ingredients or by modifying potash-feldspar mineral. The use of potash feldspar, in most instances, may introduce small amounts of other oxides (such as $Na_2O$, CaO, MgO, etc.), however, these oxides in small amounts usually do not significantly affect the thermal expansion behavior of the leucite.

The fillers according to the present invention are preferably used alone but may be combined with small amounts of silica fillers, particularly quartz. If combined, preferably 50% by weight, or less, of the silica filler is added. Most preferably, the filler comprises only leucite, only calcium difluoride, or a combination of only leucite or calcium difluoride. Investment and refractory die material powder blends containing leucite mixed with colloidal silica are easier to pour than those containing calcium difluoride and are thus somewhat preferred for most applications.

Along with the fillers, a portion of the solid binders is added to the investments and refractory die materials of the present invention. The fillers usually comprise about 50 to about 80% by weight of the investment or refractory die material. More preferably, the filler comprises between about 60 and about 70% by weight. In the Examples below, the filler comprises about 65.5% by weight of the investment or refractory die material.

The binders of the investments and refractory die materials of the present invention comprise about 20 to about 50% by weight of the material. More preferably, the binders make up about 30 to about 40% by weight. In the Examples below, the binders comprise about 34.4% by weight of the investment and refractory die material.

The binders may comprise, but are not limited to, magnesium oxide, mono- or di-ammonium phosphate, and colloidal silica in a liquid form. Other binders known to those of skill in the art may also be used.

One particularly useful binder is colloidal silica in a liquid form which is used to improve the processibility of the material so that it is easily poured into a mold. The silica liquid further enhances the setting process of the material. The silica concentration can be adjusted to adjust the setting expansion of the investment or refractory die material. Preferred concentrations of silica in colloidal silica binders are between about 30 and about 40% by weight, more preferably between about 30 and about 35% by weight.

Surfactants may also be used in trace amounts and are added to control the dispersion and surface properties of the fillers and binders. Some surfactants may include anionic, cationic and non-ionic surfactants that are well known to those of ordinary skill in the art.

According to an embodiment of the present invention, the oxide blends, or modified feldspar blends, are subjected to a fritting process above 1150° C. so as to crystallize the leucite. The fritted boule is then ground to a proper size to be used as a filler for an investment or refractory die material. $CaF_2$ having the proper particle size can be directly purchased from manufacturers or distributors or it may be ground down to an adequate size.

Once ground, the filler is added to a mixture of the binders and surfactants, and other fillers, if used. The resultant mixture is allowed to set at room temperature. When mono- or di-ammonium phosphate is used as a binder, the mixture is heated to remove the ammonium which would otherwise discolor the pigments present in the shaded porcelains. The resultant mass is subjected to a high temperature treatment process at about 1030° C.

EXAMPLES

Table I below shows the compositions of the investment and die-materials of Examples 1–5. As can be seen, the investments and refractory die materials of the present invention, shown in Examples 1–3, exhibit high thermal expansions and no sudden or large increase in thermal expansion over the temperature range of 0° to 700° C.

TABLE I

| Ingredients | Ex. 1 | Ex. 2 | Ex. 3 | Ex. 4 | Ex. 5 |
|---|---|---|---|---|---|
| Leucite | 16.4 | 8.2 | 8.2 | — | — |
| $CaF_2$ | — | 8.2 | — | — | — |
| Quartz | — | — | 8.2 | 13.6 | 16.4 |
| Cristobalite | — | — | — | 2.8 | — |
| MgO solids | 2.0 | 2.0 | 2.0 | 2.0 | 2.0 |
| MaP Monoammonium Phosphate | 1.6 | 1.6 | 1.6 | 1.6 | 1.6 |
| Colloidal Silica Liquid-30% silica | 5.0 | 5.0 | 5.0 | 5.0 | 5.0 |

Figure 2:
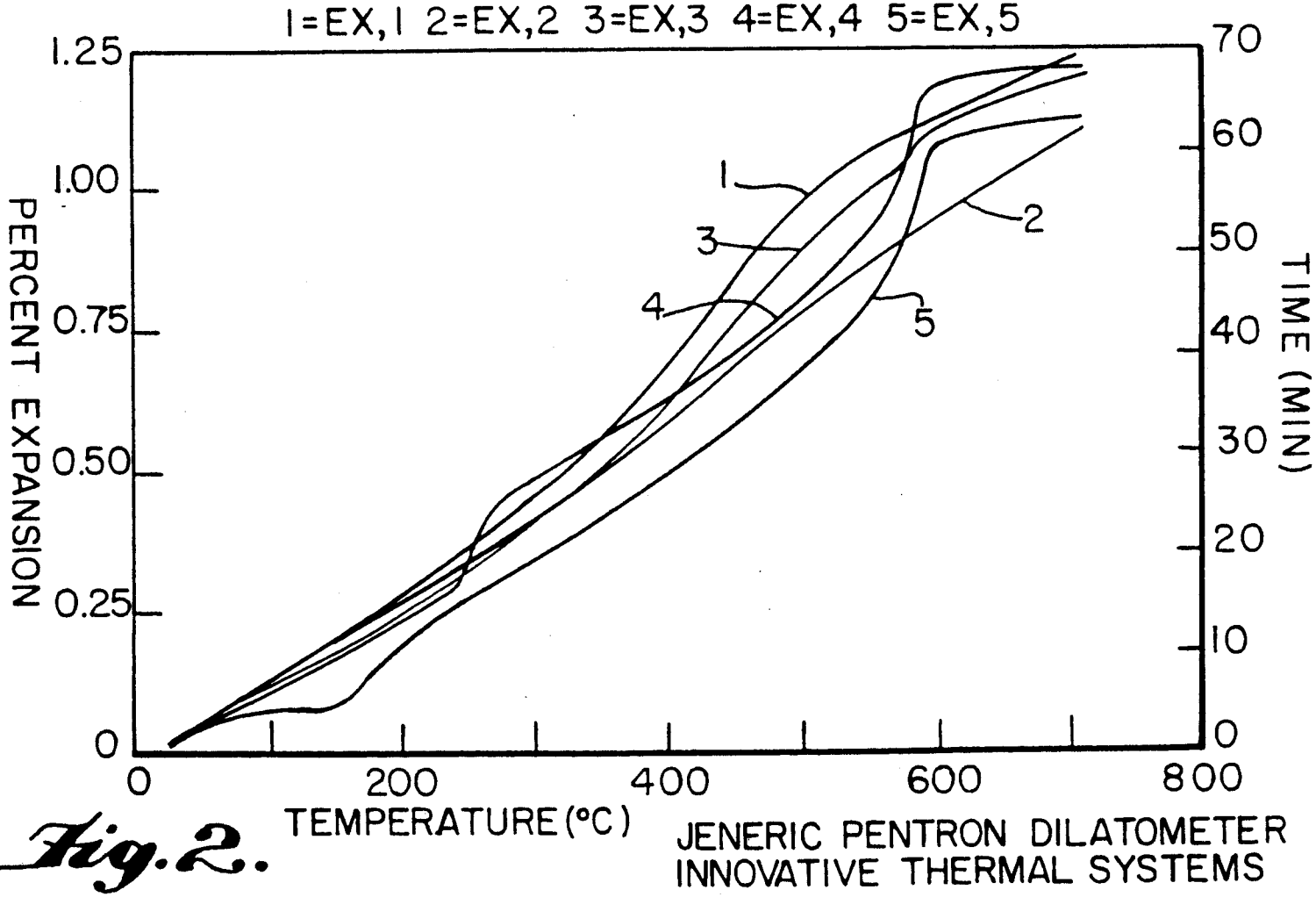
FIG. 2 is a graph showing a comparison of the thermal expansion percentage verse temperature curves for investments and refractory die materials of the prior art and for investments and refractory die materials according to the present invention.
Figure 3:
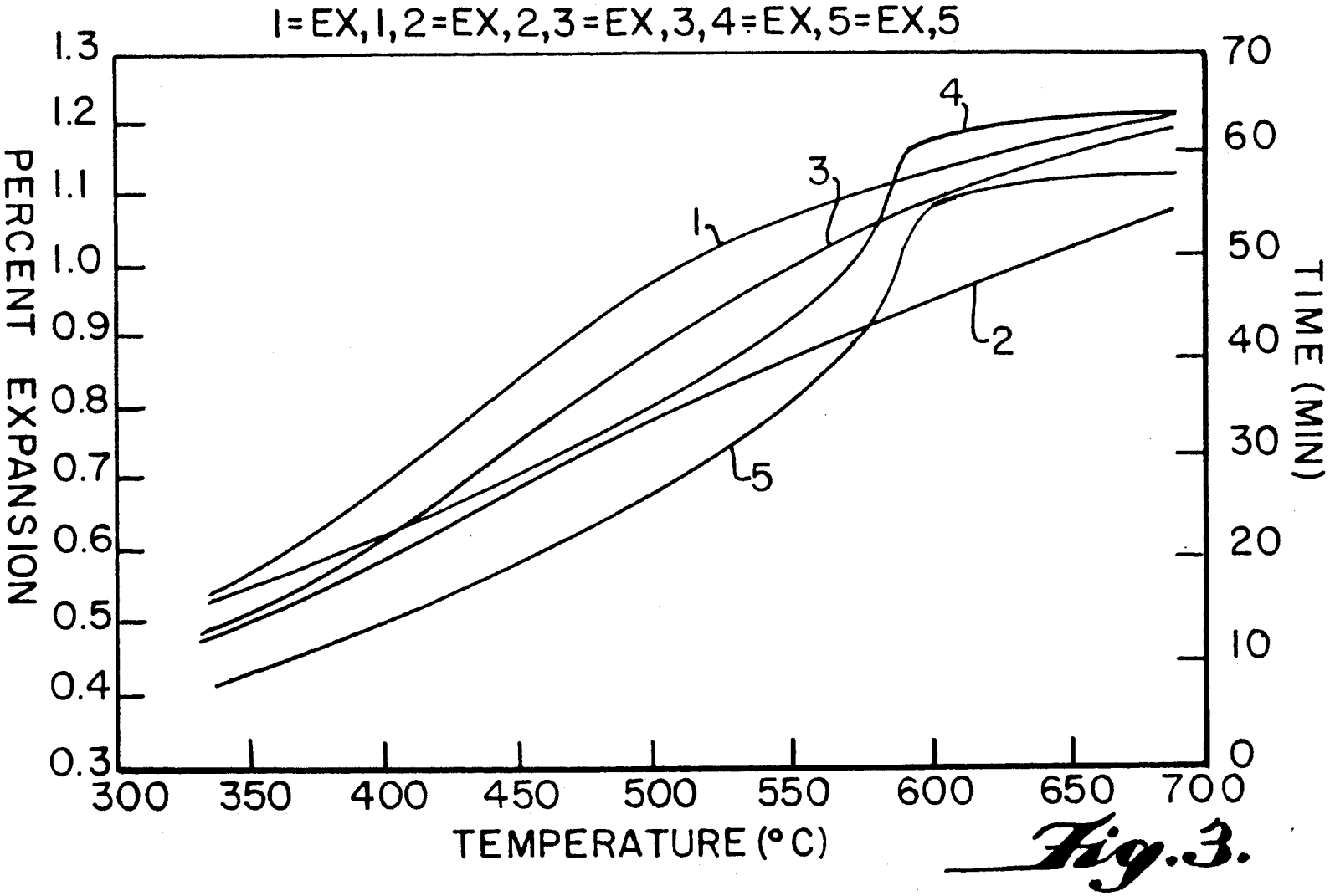
FIG. 3 is an expanded view of the graph of FIG. 2 taken over the temperature range of 350° C. to 700° C.
Figure 4:
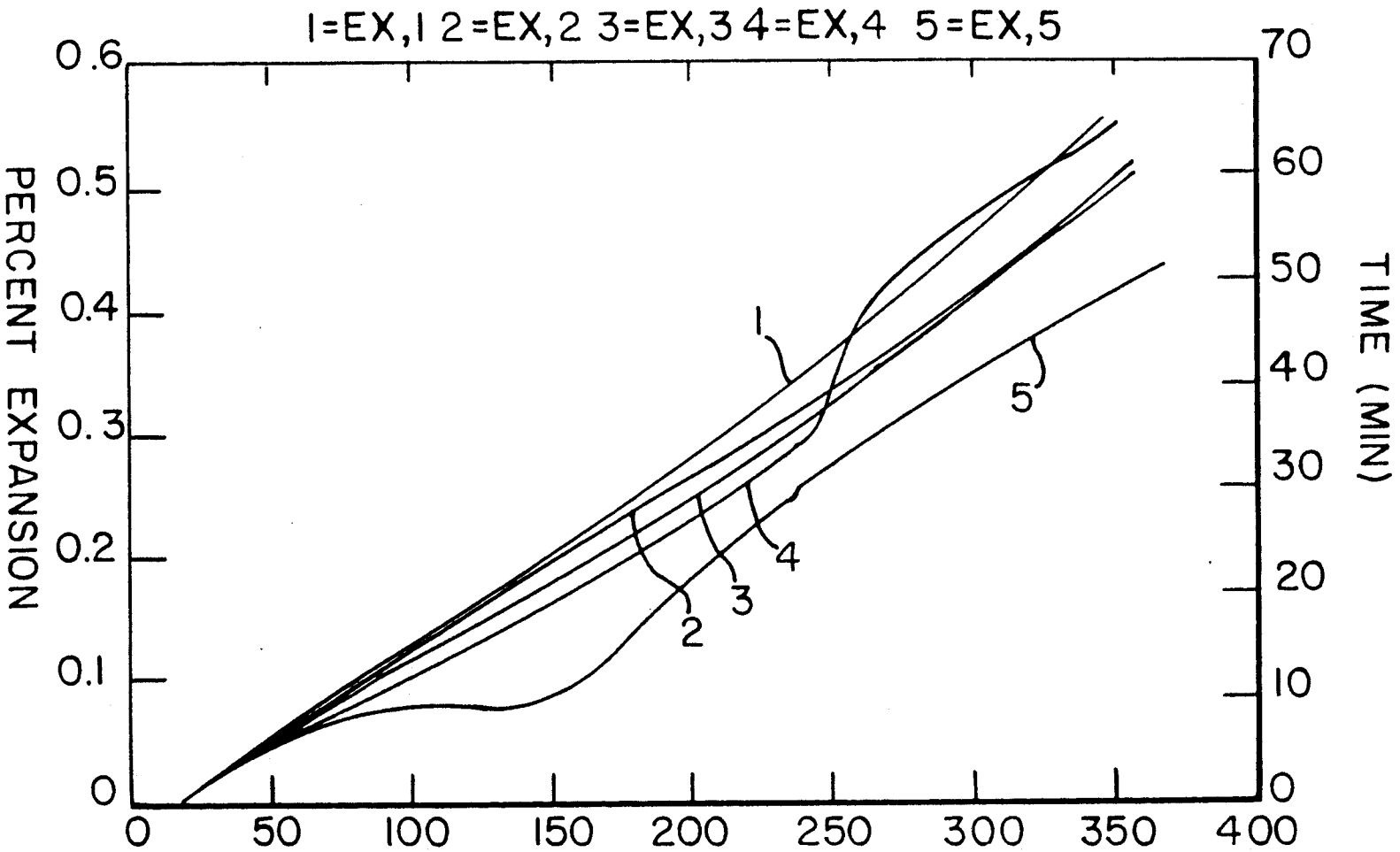
FIG. 4 is an expanded view of the graph of FIG. 2 taken over the temperature range of 0° C. to 350° C.

The thermal expansion verse temperature profiles for Examples 1–5 are shown FIG. 2. FIGS. 3 and 4 are expanded portions of the graph of FIG. 2 which have been enlarged for the purpose of clarity. It is clear from these curves that leucite and $CaF_2$ when used as fillers, alone or in combination, offer higher thermal expansion values without the presence of spikes in their thermal expansion verse temperature profiles.

Although the present invention has been described in connection with preferred embodiments, it will be appreciated by those skilled in the art that additions, modifications, substitutions and deletions not specifically described herein may be made without departing from the spirit and scope of the invention as defined in the appended claims.

What is claimed is:

1. An investment and refractory die material upon which a dental porcelain or alloy is heated, said investment and refractory die material comprising by weight:

(A) about 50 to about 80 percent filler, said filler containing greater than about 50 percent by weight based on said filler of at least one member selected from the group consisting of leucite and calcium difluoride; and (B) about 20 to about 50 percent of a phosphate-containing binder, wherein the thermal expansion of said investment and refractory die material is greater than about 0.8 percent when heated from about 25° C. to about 500° c.

2. An investment and refractory die material as defined in claim 1, further comprising a surfactant.

3. An investment and refractory die material as defined in claim 1, wherein said filler is substantially leucite.

4. An investment and refractory die material as defined in claim 1, wherein said filler is substantially calcium difluoride.

5. An investment and refractory die material as defined in claim 1, wherein said filler comprises a mixture of leucite and calcium difluoride.

6. An investment and refractory die material as defined in claim 1, comprising between about 60 and about 70 percent by weight filler.

7. An investment and refractory die material as defined in claim 1, wherein the thermal expansion of said investment and refractory die material is greater than about 0.84 and about 0.87 percent when heated from 25° C. to about 500° C.

8. An investment and refractory die material as defined in claim 1, wherein said binder comprises at least one member selected from the group consisting of magnesium oxide, mono-ammonium phosphate, di-ammonium phosphate and colloidal silica.

9. An investment and refractory die material as defined in claim 8, wherein said binder comprises colloidal silica and said colloidal silica has a silica content of between about 30 and about 40 weight percent.

10. An investment and refractory die material as defined in claim 9, wherein said colloidal silica has a silica content of between about 30 and about 35 weight percent.

11. An investment and refractory die material as defined in claim 1, wherein said phosphate-containing binder contains magnesium oxide.

12. An investment and refractory die material as defined in claim 11, wherein said phosphate-containing binder contains mono-ammonium phosphate and colloidal silica.

13. An investment and refractory die material as defined in claim 1, wherein said phosphate-containing binder comprises at least one member selected from the group consisting of mono-ammonium phosphate and di-ammonium phosphate.

14. An investment and refractory die material as defined in claim 1, wherein said binder consists essentially of members selected from the group consisting of magnesium oxide, mono-ammonium phosphate, di-ammonium phosphate and colloidal silica.

15. An investment and refractory die material upon which a dental porcelain or alloy powder is sintered, said investment and refractory die material consisting essentially of:

(A) about 50 to about 80% by weight filler, said filler containing greater than about 50% by weight based on said filler of at least one members selected from the group consisting of leucite and calcium difluoride; and (B) about 20 to about 50% by weight of a phosphate-containing binder, wherein the thermal expansion of said investment and refractory die material is greater than about 0.8% when heated from about 25° C. to about 500° C.

16. An investment and refractory die material as defined in claim 15, wherein the thermal expansion of said investment and refractory die material is between about 0.84 and about 0.87% when heated from about 25° C. to about 500° C.

17. An investment and refractory die material as defined in claim 15, wherein said phosphate-containing binder contains magnesium oxide.

18. An investment and refractory die material as defined in claim 17, wherein said phosphate-containing binder contains mono-ammonium phosphate and colloidal silica.

* * * * *